United States Patent [19]

Buringa

[11] Patent Number: 4,827,860

[45] Date of Patent: May 9, 1989

[54] FOOT OPERATED POWERED STEERING CONTROL FOR OUTBOARD MOTORS

[76] Inventor: George Buringa, 308 - 11th St. Northwest, Austin, Minn. 55912

[21] Appl. No.: 148,375

[22] Filed: Jan. 25, 1988

[51] Int. Cl.[4] ..... B63H 21/26

[52] U.S. Cl. ..... 114/153; 440/62; 74/480 B

[58] Field of Search ..... 440/753, 62, 63; 114/153, 144 RE, 160; 74/478, 484 B, 481

[56] References Cited

U.S. PATENT DOCUMENTS

| | | | |
|---|---|---|---|
| 2,804,838 | 9/1957 | Moser | 114/153 |
| 2,877,733 | 3/1959 | Harris | 114/153 |
| 2,912,877 | 11/1959 | Rohrer | 114/150 |
| 2,949,093 | 8/1960 | Smith | 440/62 |
| 2,951,460 | 9/1960 | Pierson | 440/62 |
| 2,988,037 | 6/1961 | Spencer | 114/150 |
| 3,080,953 | 3/1963 | Edgewood | 114/160 |
| 3,930,461 | 1/1976 | Brock et al. | 440/6 |
| 3,968,768 | 7/1976 | Solt | 440/62 |
| 4,255,984 | 3/1981 | Abels et al. | 74/474 |
| 4,348,193 | 9/1982 | Arndt | 440/62 |
| 4,631,033 | 12/1986 | Menne | 440/7 |
| 4,631,034 | 12/1986 | Menne et al. | 440/7 |

*Primary Examiner*—Joseph F. Peters, Jr.
*Assistant Examiner*—Edwin L. Swinehart
*Attorney, Agent, or Firm*—Schroeder & Siegfried

[57] ABSTRACT

A foot operated powered steering control for an outboard motor used in a boat comprising a bidirectional motor which drives a winch carrying a pair of steering cables in opposite winding directions. The steering cables are connected to the outboard motor of the boat in such a manner that as the bidirectional motor operates in a forward rotational direction, one of the cables will be wound around the winch as the other cable unwinds, thereby causing the motor to turn toward one side of the boat, and as the bidirectional motor operates in the reverse rotational direction the other cable will be wound around the winch as the first cable is unwound, thereby causing the motor to turn towards the opposite side of the boat. A rotatably mounted foot pedal is connected to the bidirectional motor housing, and the rotation of the foot pedal in one direction causes the bidirectional motor to operate in a forward rotational direction while the rotation in the foot pedal in the other direction causes the bidirectional motor to operate in the reverse rotational direction.

21 Claims, 1 Drawing Sheet

FOOT OPERATED POWERED STEERING CONTROL FOR OUTBOARD MOTORS

BACKGROUND OF THE PRIOR ART

The apparatus described herein relates generally to the field of steering devices for outboard motors on boats. More particularly, the apparutus described herein relates to a steering device which may be operated solely by minor movement of one's foot.

Boats carrying outboard motors have long since been used for fishing, transportation and other pleasure means. The conventional outboard motor is generally pivotally mounted about a vertical axis on the rear of the boat and is designed to be operated by an operator who sits adjacent the motor. Most conventional outboard motors are designed so that the operator may steer and accelerate the boat by using arm and wrist movement on a steering handle connected to the motor. Such an arrangement for operating the boat is satisfactory when the boat is being used for pleasure or transportation. However, when fishing, quite often the operator needs to use both of his hands to cast and reel the fishing rod while at the same time operating the boat. For example, quite often a person will troll for fish, thereby requiring the fisherman to operate the fishing reel while at the same time steering and operating the outboard motor. Furthermore, it is also possible that a fisherman may be handicapped and unable to use one of his hands or arms to operate the boat while fishing.

In the past, devices have been designed which operate the steering of an outboard motor by the use of a person's feet. However, such conventional devices have required manual mechanical operation, such as that shown in the U.S. Pat. No. 2,988,037 wherein the operator of the boat must operate the steering of the outboard motor by using his leg and foot to manually rotate the drive wheel D in order to turn the motor. Such devices as shown in U.S. Pat. No. 2,988,037 require continual attention by the operator to keep the motor from automatically turning itself, as an outboard motor quite often will do when unattended, thereby causing the leg and foot of the operator to become quickly fatigued.

There has been a long felt need for a means of operating the steering of a outboard motor which can be easily operated by minor foot movement. There has also been a need for a device which does not require continual attention in order to keep the motor from turning without the aid of the operator. My invention solves these problems and provides an effective means of steering an outboard motor attached to a boat without the use of the operator's hands by utilizing a powered bidirectional motor to cause the turning of the outboard motor which may be operated by minor foot movement.

BRIEF SUMMARY OF THE INVENTION

As mentioned above, my invention is related generally to steering devices for outboard motors used in a boat, and more particularly to a foot operated powered steering control for such a motor. My invention is comprised generally of a bidirectional motor which is enclosed within a housing and has a foot pedal extending therefrom which is used to activate the bidirectional motor in whatever direction desired. The bidirectional motor is designed to operate in a forward rotational direction or a reverse rotational direction. Extending from the rotational drive unit of the bidirectional motor is a winch means which carries a pair of steering cables in oppositely wound relation. The other end of each steering cable is connected through a pulley system to the outboard motor which is pivotally connected to the rear of the boat.

The winch means is further comprised of an elongated rod which engages the drive unit of the bidirectional motor and carries a plurality of disks or guides which are used to guide and separate the respective steering cables as the same wind and unwind from around the elongated rod of the winch means. In effect, the elongated rod and guides which make up the winch means form a pair of spools, one spool each having one steering cable wound therearound in an opposite direction relative to the winding of the other steering cable.

The foot pedal, which is carried by a shaft connected to the housing for the bidirectional motor is rotatably mounted thereto. The foot pedal is connected at each of its transverse sides to a separate elongated actuation lever which controls the operation of the bidirectional motor. As the foot pedal is rotated in one direction, one of the actuation levers will be depressed, thereby engaging the actuation switch for the bidirectional motor and causing the bidirectional motor to operate in a forward rotational direction. By rotating the foot pedal in the opposite direction, the actuation lever connected to the opposite transverse side of the foot pedal will be depressed, thereby engaging the actuation switch in such a manner that the bidirectional motor operates in a reverse rotational direction.

In operation, when the fisherman desires to turn the motor of the boat in one direction, by applying minimal foot pressure to one side of the foot pedal, thereby rotating the same in one direction, the bidirectional motor will activate and cause the winch means to rotate in a corresponding direction. One steering cable will then be wound around the winch means as the other steering cable is unwound. The steering cable which is wound onto the winch means will pull the outboard motor and cause the same to be rotated in a direction toward one side of the boat, thereby causing the boat to turn. At the same time, the other steering cable is released or unwound from the winch so as to allow the motor to freely turn. To turn the motor back in the opposite direction, the operator applies foot pressure to the other side of the foot pedal, thereby causing the same to rotate in the opposite direction. The corresponding actuation lever is depressed by the rotation of the foot pedal, thereby activating the bidirectional motor in an opposite rotational direction and causing the previously unwound steering cable to begin winding and the previously wound steering cable to unwind, resulting in the motor turning in the opposite direction.

The use of such a foot operated powered steering control is extremely useful for a fisherman who wishes to fish by trolling as the boat moves through the water, or for a fisherman who may be handicapped and unable to use one of his hands or arms in order to operate the boat while fishing.

It can further be seen that the use of this invention provides a means for controlling the steering of an outboard motor in a boat by the use of the operators foot with only minimal movement required. Thus, the operator of the boat does not become leg weary or fatigued while fishing, thereby enhancing the enjoyment of the same.

DETAILED DESCRIPTION OF THE INVENTION

Figure 1:
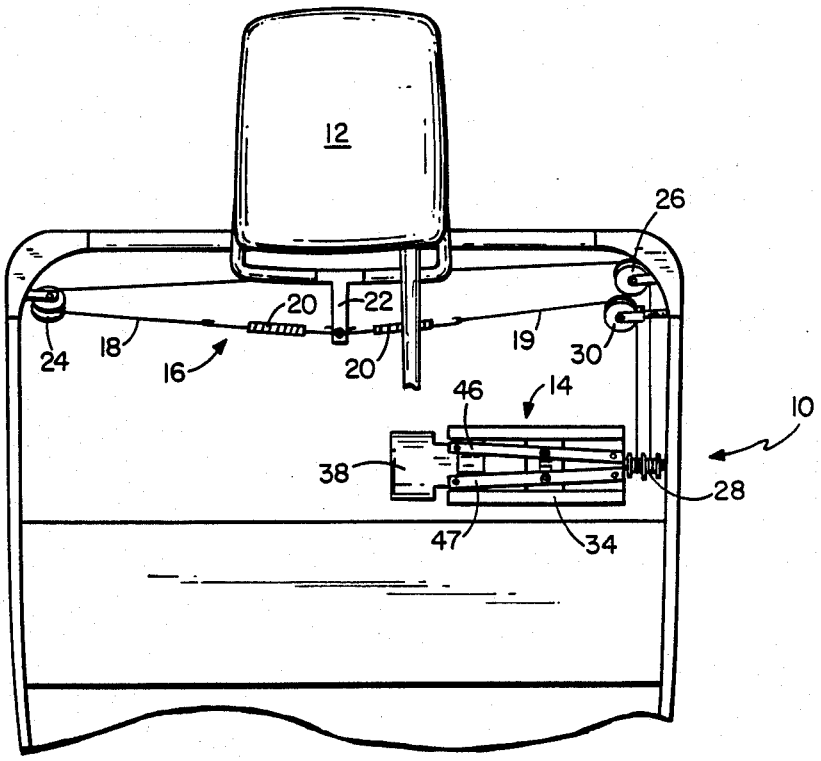
FIG. 1 is a fragmentary top plan view of the rear portion of a boat having an outboard motor pivotally carried thereby, and showing the powered steering apparatus, which is the subject of invention, affixed to the bottom of the boat and actuated by the operator's foot.

Shown in FIG. 1 is the rear end of a boat 10 the transom of which carries an outboard motor 12 which is pivotally mounted thereto, and further showing the foot operated powered steering apparatus, which is the subject of this invention, fixedly connected to the boat 10 and connected to the outboard motor 12 through a cabling system 16. The cabling system 16 is further comprised of a pair of connecting cables 18 and 19, each of which has one end connected to one end of a spring 20. The other end of each spring 20 is connected to the outboard motor 12 by T-flange 22, as viewed from FIG. 1. Cable 18 extends transversely toward the left side of the boat around pulley 24, which is connected to the left side of the boat, and then back across the rear end of the boat toward pulley 26. Cable 18 continues around pulley 26, which is connected to the right rear end of the boat, to the winch means 28 which is carried and driven by the foot operated powered steering means 14. Connecting cable 19 extends from the outboard motor 12 towards the right side of the boat around pulley 30 which is also connected to the right rear end of the boat, and then to the winch means 28.

Figure 2:
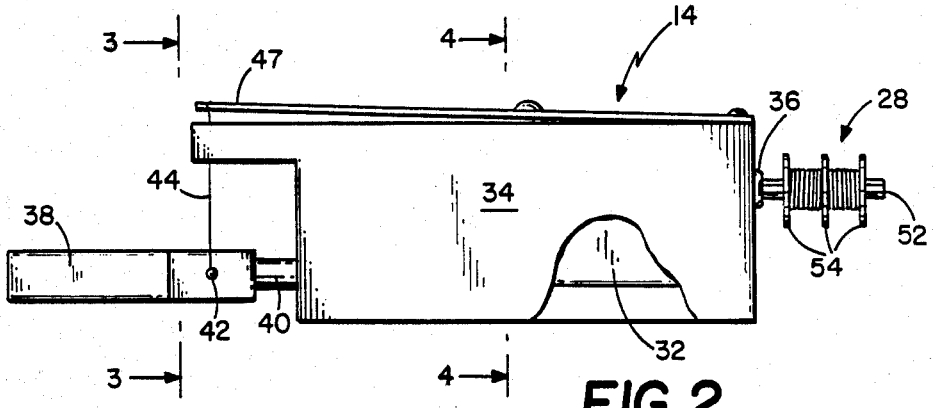
FIG. 2 is a side elevational view of the steering apparatus which is the subject of this invention, showing a rotatable foot pedal connected at each transverse side to an elongated actuation lever which actuates the bidirectional power means, and further showing the winch which is carried and driven by the bidirectional power means and supports the connecting cables to the outboard motor.

As best shown in FIG. 2, the foot operated power steering means 14 is comprised of a bidirectional drill motor 32 which is surrounded by a housing 34. Extending from the front end of the housing 34 is the drive unit 36 of the bidirectional motor 32. Drive unit 36 carries the winch means 28 to which each connecting cable is connected and wound in opposite winding directions (best shown in FIG. 5). Extending from the other end of housing 34 is a pivotal foot pedal 38 which is constructed and arranged to pivot about a shaft 40 which is fixedly connected to the housing 34. The foot pedal 38 is freely pivotal in either direction about shaft 40. On each transverse side relative to the axis of rotation of foot pedal 38 there extends outwardly a pin 42 which has a connector means 44, such as a wire, extending upwardly therefrom to connect at its other end to one of a pair of actuation levers 46 and 47 which are seated on the top face of housing 34 and connected thereto at the front end thereof. The actuation levers 46 and 47 extend from the front end of the housing 34 to a point adjacent the rear end of the housing 34 where they terminate at a position which is generally vertically disposed of the foot pedal 38.

Figure 3:
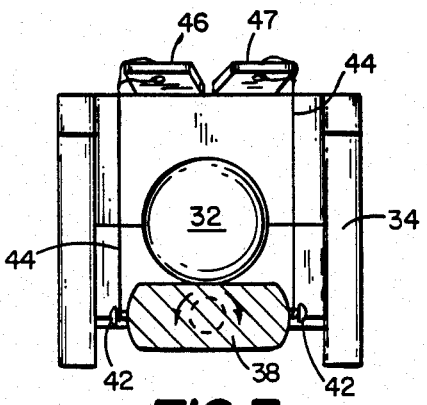
FIG. 3 is a rear elevational view of the foot operated powered steering apparatus for an outboard motor showing a connection between the pivotal foot pedal and the elongated actuation levers seated on the top side of the motor housing.
Figure 4:
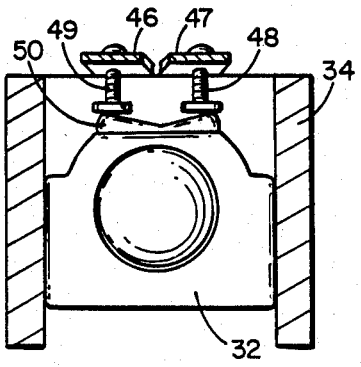
FIG. 4 is a front sectional view of the foot operated powered steering apparatus for an outboard motor, showing a pair of actuation pins extending downardly from the actuation levers to make contact and engage the actuation switch of the bidirectional motor.

Each actuation lever 46 and 47 carries a downwardly extending actuation pin 48, 49 which is constructed to extend toward the bidirectional actuation switch 50 of the bidirectional motor 32 in engaging relation. Thus, as can be best seen in FIG. 3, as the foot pedal 38 is rotated in a clockwise direction (relative to the drawing as shown in FIG. 3), actuation lever 47 will be pulled downwardly by connector means 44, thereby causing the downwardly extending actuation arm 48 to depress the actuation switch 50 on one side. The ending result is that the bidirectional motor is actuated in one of its two rotational directions of operation. By rotating the foot pedal 38 in a counterclockwise direction, the actuation lever 46 will be pulled downwardly by the opposite connector means 44 which is connected thereto, thereby causing the actuation arm 49 to depress the opposite side of the actuation switch 50. By so doing, the direction of operation of the bidirectional motor 32 will be reversed.

Figure 5:
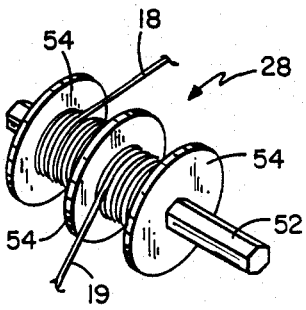
FIG. 5 is an expanded perspective view of the winch portion of the foot operated powered steering apparatus for an outboard motor, showing the outboard connecting cables being oppositely wound around the winch means to effectuate the proper turning of the outboard motor.

As best shown in FIG. 5, each connecting cable 18 and 19 are oppositely wound around the winch means 28. The winch means 28 is more specifically comprised of an elongated rod 52 which carries a plurality of guides 54 which act as barriers to separate and contain the connecting cables 18 and 19 within a specific area along the length of rod 52. In essence, the guides 54 form a pair of spools wherein at least one guide member 54 separates the pair of connecting cables 18 and 19. The connecting cables 18 and 19 are oppositely wound around the winch 28 so that, as the bidirectional motor operates in one rotational direction, cable 18 will be wound around rod 52 and cable 19 will unwound from the same. When the bidirectional motor 32 operates in the opposite direction, cable 19 will be wound around rod 52 as cable 18 is released or unwound therefrom.

In describing the full operation of the invention disclosed herein, for illustrative purposes only, it will be helpful to refer to the bidirectional motor as operating in the forward direction when the foot pedal 38 is pivoted in a clockwise direction (as viewed from FIG. 3), and operating in a reverse rotational direction as the foot pedal 38 is pivoted in a counterclockwise direction.

The foot operated powered steering apparatus as described herein is designed so that a person may steer a boat having an outboard motor without the use of his hands and with only minimal movement of his foot. By so doing, the operator may enjoy riding in the boat while having his hands free so that he may fish. It is also been designed to alleviate the problems which a handicapped person who has only one arm may have in trying to operate a boat.

The operator places his foot on foot pedal 38. When a turn in one direction is desired the operator may pivot pedal 38 in a clockwise direction with minimal foot movement, thereby causing the actuation lever 47 to be pulled downwardly. Depression of actuation lever 47 causes actuation pin 48 to engage and depress actuation switch 50 on one end, thereby causing the bidirectional motor 32 to operate in the forward rotational direction. The drive unit 36 of the bidirectional motor will then turn in a forward rotational direction, thereby causing the winch 28, which is carried therein to also rotate in the forward rotational direction.

For illustrative purposes only, assuming that connecting cable 18 is wound around rod 52 as the winch means 28 rotates in a forward rotational direction, it can be seen from FIG. 1 that as cable 18 is wound around rod 52 of the winch means 28, the outboard motor 12 will rotate and the front end of outboard motor 12 will be caused to turn towards the left side of the boat (as shown in FIG. 1). At the same time, cable 19 will unwind from winch 28, thereby allowing slack in cable 19 so as to enable the outboard motor 12 to turn.

If the operator desires to turn the outboard motor 12 in the opposite direction (towards the right side of the boat), he may apply pressure to the opposite side of the foot pedal 38, thereby causing the same to rotate in a counter clockwise direction and cause actuation lever 46 to be pulled downwardly. Actuation lever 46, in turn, causes actuation pin 49 to engage and depress the opposite side of actuation switch 50. The bidirectional motor 32 will then operate in the reverse rotational direction and cause drive unit 36 of the same, as well as winch 28, to rotate in a reverse direction. In this case, connecting cable 19 will wind around rod 52 of winch 28 and connecting cable 18 will unwind from winch 28. As can be seen from FIG. 1, when this occurs, the outboard motor 12 rotates in the opposite direction and the front end of outboard motor 12 is pulled towards the right side of the boat. Cable 18 is released, thereby allowing slack in the cable so that the outboard motor 12 may turn.

As is easily seen, the operation of my invention regarding the foot operated powered steering control device for outboard motors requires minimal movement of the operator's foot to effectuate the turning of the outboard motor. Consequently, far less fatigue and frustration is felt by the operator, thereby making the operator's time spent in the boat while fishing or enjoyment riding much more enjoyable.

In considering this invention, it should be remembered that this disclosure is illustrative only, and the scope of the invention should be determined by the appended claims.

I claim:

1. A foot operated apparatus for controlling the steering of an outboard motor which is mounted directly on the transom of a boat, comprising:

(a) a bidirectional power means constructed and arranged to operate in a forward rotational direction and in a reverse rotational direction;

(b) a foot pedal pivotally connected to said bidirectional power means in actuating relationship, said foot pedal being constructed and arranged to cause said bidirectional power means to operate in said forward direction when pivoted in one direction and to cause the bidirectional motor to operate in said reverse direction when pivoted in the opposite direction;

(c) a winch means connected to said power means in a controlled relation thereto, said winch means being constructed and arranged to be driven by said power means and to rotate in the same direction relative to the direction of operation of said power means;

(d) a pair of cables connected at one end to said winch means in opposite winding relation, each said cable being wound around said winch means as the other said cable is unwound from the same, the winding and unwinding of each said cable depending upon the relative operational direction of said power means; and (e) said cables being connected at their other ends directly to the outboard motor in such a manner that as said bidirectional power means operates in the forward or reverse direction the outboard motor will be turned relative to the transom upon which it is mounted in a direction relative to the pulling force of said cable being wound onto said winch means.

2. The structure defined in claim 1, wherein said winch means is further comprised of an elongated rod carrying a plurality of spaced guides which extend radially outward from said rod and circumferentially therearound in a plane transverse thereto, said guides being constructed and arranged to form a pair of spools, each said spool being adapted to receive one of said cables.

3. The structure defined in claim 2, wherein one of said cables is wound clockwise around said elongated rod, and the other said cable is wound counterclockwise around said elongated rod, said cables being separated by at least one guide disposed therebetween.

4. The structure defined in claim 1, wherein said pair of cables is separated by at least one guide which extends radially outward and circumferentially around said winch means.

5. The structure defined in claim 1, including a pair of elongated actuation bars, one end of each being connected to said bidirectional power means, and the other end of each being connected to opposite transverse faces of said foot pedal relative to its axis of rotation, whereby rotational movement of said foot pedal in one direction will cause one of said actuation bars to be depressed, thereby actuating said bidirectional power means in the forward rotational direction, and rotational movement of said foot pedal in the opposite direction will cause the other said actuation bar to be depressed, thereby causing said bidirectional power means to operate in the reverse rotational direction.

6. A foot controlled steering apparatus, comprising:

(a) a boat having a transom;

(b) an outboard motor mounted directly on said transom of said boat and constructed and arranged to rotate about a vertical axis;

(c) a winch means connected directly to said outboard motor to cause rotation of said outboard motor relative to said transom;

(d) a bidirectional power means having a forward rotational direction and a reverse rotational direction, and being operatively connected to said outboard motor by said winch means in a steering-control relation, said power means being constructed and arranged to cause said boat to turn in one direction as said power means operates in its said forward rotational direction, and to cause said boat to turn in the other direction as said power means operates in its said reverse rotational direction;

(e) a foot operated control means connected to said bidirectional power means for controlling the direction of operation of said bidirectional power means; and (f) a pair of cables, each having one end connected to said winch means and each having its other end connected directly to said motor, and each of said cables being connected to said winch means in opposite winding relation so that as said winch means rotates, one of said cables will be wound around said winch means while the other said cable will be unwound from the same, thereby causing the outboard motor to rotate in a direction relative to the pulling force of said cable being wound onto said winch means.

7. The structure defined in claim 6, wherein said foot operated control means is pivotally connected to said bidirectional power means and constructed and arranged such that rotation of said control means in one direction will cause said bidirectional power means to operate in said forward rotational direction, and rotation of said control means in the opposite direction will cause said bidirectional power means to operate in said reverse rotational direction.

8. The structure defined in claim 6, including:

(g) said winch means being carried by said power means in a controlled relation thereto, said winch means being constructed and arranged to be driven by said power means in a rotational direction relative to the rotational direction of operation of said power means.

9. The structure defined in claim 8, wherein said winch means is further comprised of an elongated rod carrying a plurality of guides which extend radially outward therefrom and circumferentially therearound in a plane transverse to the longitudinal axis of said rod, said cables being wound oppositely around said elongated rod and separated by at least one guide.

10. The structure defined in claim 9, wherein a pair of spools are defined by said guides, each of said spools being comprised of a pair of guides axially spaced along the length of said elongated rod.

11. The structure defined in claim 7, wherein said control means is comprised of a foot pedal having a central bore in one end thereof, said foot pedal being constructed and arranged to telescopically receive in said bore an outwardly extending shaft which is fixedly connected to said bidirectional power means, whereby said foot pedal may freely rotate about said shaft.

12. The structure defined in claim 7, wherein opposite sides of said foot operated control means are each connected at a point transversely spaced relative to the axis of rotation of same to one end of an elongated lever which is cantilevered at its other end to said bidirectional power means, each said lever being constructed and arranged to engage an actuation switch connected to said bidirectional power means upon relative rotation of said control means, whereby engagement of said actuation switch by each said lever causes said power means to operate in an opposite direction.

13. A foot control steering apparatus for an outboard motor mounted directly on the transom of a boat, comprising:

(a) a bidirectional power means constructed and arranged to operate in a forward or reverse rotational direction;

(b) a foot operated control means movably connected in controlling relation to said bidirectional power means and constructed and arranged to operate said bidirectional power means in either of said rotational directions, depending upon the relative movement of said control means; and (c) a steering control means including a winch means connecting said bidirectional power means directly to the outboard motor in a steering control relation thereto, said steering control means being constructed and arranged to rotate the outboard motor relative to the transom upon which it is mounted in one direction when said bidirectional power means is operated in a forward rotational direction, and to rotate the outboard motor relative to the transom upon which it is mounted in the other direction when said bidirectional power means is operated in said reverse rotational direction.

14. The structure defined in claim 13, wherein said steering control means is further comprised of:

(d) a pair of cables connected to said winch means at one end in opposite winding relation and at the other end to the outboard motor of the boat, each said cable being constructed and arranged to turn the outboard motor towards one side of the boat when such said cable is wound about said winch means.

15. The structure defined in claim 14, wherein said winch means includes an elongated rod which carries a plurality of guides, said guides being constructed and arranged to separate said oppositely wound cables and to contain the winding of such said cables to a predetermined area along the length of said rod.

16. The structure defined in claim 15, wherein at least one of said guides separates said pair of cables.

17. The structure defined in claim 13, wherein said foot operated control means is rotatably mounted to said bidirectional power means and constructed and arranged to actuate said bidirectional power means in said forward rotational direction when said foot operated control means is rotated in one direction, and to actuate said bidirectional power means in its reverse rotational direction when said foot control means is rotated in an opposite direction.

18. The structure defined in claim 17, wherein said foot operated control means is connected to a pair of actuation levers which are carried by said bidirectional power means, each said actuation lever being connected to a transverse side of said foot operated control means relative to the rotational axis of the same, whereby the rotation of said foot operated control means in one direction causes one of said actuation levers to be depressed, thereby causing actuation of said bidirectional power means in one of said rotational directions, and rotation of said foot pedal in the opposite direction causes said other actuation lever to be depressed, thereby causing actuation of said power means in the opposite said rotational direction.

19. A foot operated apparatus for controlling the steering of an outboard motor on a boat, comprising:

(a) a bidirectional power means constructed and arranged to operate in a forward rotational direction and in a reverse rotational direction;

(b) a foot pedal pivotally connected to said bidirectional power means in actuating relationship, said foot pedal being constructed and arranged to cause said bidirectional power means to operate in said forward direction when pivoted in one direction and to cause the bidirectional motor to operate in said reverse direction when pivoted in the opposite direction;

(c) a winch means connected to said power means in a controlled relation thereto, said winch means being constructed and arranged to be driven by said power means and to rotate in the same direction relative to the direction of operation of said power means;

(d) A pair of cables connected at one end to said winch means in opposite winding relation, each said cable being wound around said winch means as the other said cable is unwound from the same, the winding and unwinding of each said cable depending upon the relative operational direction of said power means;

(e) said cables being connected at their other ends to the outboard motor in such a manner that as said bidirectional power means operates in the forward or reverse direction the outboard motor will be turned in a direction relative to the pulling force of said cable being wound onto said winch means; and (f) a pair of elongated actuation bars, one end of each being connected to said bidirectional power means, and the other end of each being connected to opposite transverse faces of said foot pedal relative to its axis of rotation, whereby rotational movement of said foot pedal in one direction will cause one of said actuation bars to be depressed, thereby actuating said bidirectional power means in the forward rotational direction, and rotational movement of said foot pedal in the opposite direction will cause the other said actuation bar to be depressed, thereby causing said bidirectional power means to operate in the reverse rotational direction.

20. A foot controlled steering apparatus, comprising:

(a) a boat;

(b) an outboard connected to the rear of said boat and constructed and arranged to rotate about a vertical axis;

(c) a bidirectional power means having a forward rotational direction and a reverse rotational direction, and being connected to said outboard motor in a steering-control relation, said power means being constructed and arranged to cause said boat to turn in one direction as said power means operates in its said forward rotational direction, and to cause said boat to turn in the other direction as said power means operates in its said reverse rotational direction;

(d) a foot operated control means being pivotally connected to said bidirectional power means for controlling the direction of operation of said bidirectional power means, said control means being constructed and arranged such that rotation of said control means in one direction will cause said bidirectional power means to operate in said forward rotational direction, and rotation of said control means in the opposite direction will cause said bidirectional power means to operate in said reverse rotational direction; and (e) said foot operated control means being comprised further of a foot pedal having a central bore in one end thereof, said foot pedal being constructed and arranged to telescopically receive in said bore an outwardly extending shaft which is fixedly connected to said bidirectional power means, whereby said pedal may freely rotate about said shaft.

21. A foot controlled steering apparatus, comprising:

(a) a boat;

(b) an outboard motor connected to the rear of said boat and constructed and arranged to rotate about a vertical axis;

(c) a bidirectional power means having a forward rotational direction and a reverse rotational direction, and being connected to said outboard motor in a steering-control relation, said power means being construed and arranged to cause said boat to turn in one direction as said power means operates in its said forward rotational direction, and to cause said boat to turn in the other direction as said power means operates in its said reverse rotational direction;

(d) a foot operated control means being pivotally connected to said bidirectional power means for controlling the direction of operation of said bidirectional power means, said control means being constructed and arranged such that rotation of said control means in one direction will cause said bidirectional power means to operated in said forward rotational direction, and rotation of said control means in the opposite direction will cause said bidirectional power means to operate in said reverse rotational direction; and (e) said foot operated control means has opposite sides, each of which are connected at a point transversely spaced relative to the axis of rotation of same to one end of an elongated lever which is cantilevered at its other end to said bidirectional power means, each said lever being constructed and arranged to engage an actuation switch connected to said bidirectional power means upon relative rotation of said control means, whereby engagement of said actuation switch by each said lever causes said power means to operate in an opposite direction.

* * * * *